United States Patent [19]

Hrycyshyn

[11] Patent Number: 4,732,543

[45] Date of Patent: Mar. 22, 1988

[54] LIQUID SENSOR SYSTEMS FOR LIQUID-EMPLOYING APPARATUS AND SENSORS FOR USE IN SUCH SYSTEMS

[75] Inventor: Michael S. Hrycyshyn, Stoney Creek, Canada

[73] Assignee: Moyer Diebel Limited, Jordan Station, Canada

[21] Appl. No.: 904,080

[22] Filed: Sep. 4, 1986

[30] Foreign Application Priority Data

Sep. 16, 1985 [CA] Canada ..... 490859

[51] Int. Cl.[4] ..... F04B 49/06

[52] U.S. Cl. ..... 417/44; 73/304 C; 340/620; 324/61 P; 361/285

[58] Field of Search ..... 417/36, 44, 138; 340/605, 620, 618; 361/284, 285; 73/304 C; 324/61 P

[56] References Cited

U.S. PATENT DOCUMENTS

| | | | |
|---|---|---|---|
| 2,575,492 | 11/1951 | Dittmann | 361/285 X |
| 2,664,556 | 12/1953 | Sontheimer | 340/207 |
| 2,691,223 | 10/1954 | Oberlin | 361/284 X |
| 3,342,138 | 9/1967 | Parks et al. | 340/418 |
| 3,391,547 | 7/1968 | Kingston | 73/304 C X |
| 3,520,638 | 7/1970 | McUmber et al. | 417/36 |
| 3,537,616 | 11/1970 | Diebel et al. | 222/66 |
| 4,203,099 | 5/1980 | Edwards | 340/619 |
| 4,261,397 | 4/1981 | Guy | 141/1 |
| 4,334,547 | 6/1982 | Diebel et al. | 134/46 |
| 4,354,219 | 10/1982 | Akita | 73/304 C X |
| 4,470,008 | 9/1984 | Kato | 73/304 C X |
| 4,603,581 | 8/1986 | Yamanoue | 340/620 X |

FOREIGN PATENT DOCUMENTS

| | | | |
|---|---|---|---|
| 623189 | 9/1978 | U.S.S.R. | 417/36 |
| 800855 | 1/1981 | U.S.S.R. | 324/61 P |

*Primary Examiner*—Leonard E. Smith
*Attorney, Agent, or Firm*—Rogers & Scott

[57] ABSTRACT

A liquid sensor system particularly suitable for commercial washing machines for drinking glasses and soft drink dispensers employs a capacitive detector providing a tortuous path through which the liquid passes and constituting part of the dielectric of the resultant capacitor. The pumps supplying the liquid through the capacitor to the dispensing means are controlled in accordance with the capacitance, as measured by a circuit. A preferred measuring circuit comprises a pulse generator; one series of pulses split from the generator output is delayed by a fixed period and fed to a flip-flop, while the second series also from the generator output are delayed by a period dependent upon the sensor capacitance and are also fed to the flip-flop, the output of which is dependent upon which series of pulses is in advance of the other. The circuit also provides for automatic adjustment of its sensitivity upon start-up or reset to adjust for differences in the sensors and the liquids.

16 Claims, 5 Drawing Figures

LIQUID SENSOR SYSTEMS FOR LIQUID-EMPLOYING APPARATUS AND SENSORS FOR USE IN SUCH SYSTEMS

FIELD OF THE INVENTION

The invention is concerned with liquid sensor systems for liquid-employing apparatus, such as commercial washing machines for drinking glasses and drink vending machines, and with sensors for the liquids dispensed in such apparatus.

REVIEW OF THE PRIOR ART

One kind of apparatus to which the present invention is particularly applicable is a commercial washing machine for drinking glasses, such as is employed in restaurants, hotels, saloons, etc., to wash the glasses automatically or under control of an operator. An example of apparatus of this type is described in our U.S. Pat. No. 4,334,547, issued June 15, 1982, the disclosure of which is incorporated herein by this reference. In this machine the glasses are carried by a horizontal moving perforated belt through successive stations in which they are pre-rinsed, washed with a detergent solution, and hot rinsed. Typically the wash water is discarded after each wash and the hot rinse water is used for the next wash operation. In the interests of good hygiene, in many jurisdictions, the operation of such machines is now the subject of health regulations which set minimum standards for the washing and rinsing operations, including the nature and concentration of the substances added to the wash and rinse waters. In practice, such a machine must include some method of detecting when any of the added chemicals, which are almost always liquids because of their ease of dispensing is exhausted and indicate this fact to the operator, usually by means of an "out of chemical" light and a buzzer. It may also be arranged that the machine is shut down when this occurs. It is desirable, if not essential, for the machine not to operate when an operator substitutes plain water for the exhausted chemical solution in order to try to keep the machine running, or attempts to economize by using a more diluted solution than is proper.

Another machine to which the invention is applicable is a drink vendor of the kind which contains an assortment of liquid concentrates (syrups), a cylinder of carbon dioxide, and header tanks of hot and cold water, and prepares each drink upon demand. Such a machine must include a detector for each concentrate which will stop it from dispensing the respective drink when the concentrate is exhausted. A prior example of such a machine is disclosed in our U.S. Pat. No. 3,537,616, issued Nov. 3, 1970, in which a coil of tubing through which the syrup must pass to the dispensing nozzle is weighed and a relay is operated when the mechanical weighing mechanism detects that the coil is empty.

DEFINITION OF THE INVENTION

It is an object of the invention to provide a new liquid sensing system for liquid-employing machines that is flexible in the nature of the liquids that can be employed with it.

It is another object to provide a new form of capacitive detector for use in such systems.

In accordance with the present invention there is provided a liquid sensor system for liquid-employing apparatus comprising:

a capacitive liquid sensor adapted to have the liquid to be detected as part of the dielectric therein, motor and pump means receiving liquid to be detected from a source thereof and pumping it through the capacitive detector, a capacitance measuring circuit connected to the said capacitive detector and producing a first electric output when the detector is empty of liquid and a second output when it is full of liquid, and motor control means operative upon receipt of said first electric output of the capacitance measuring circuit to stop operation of the motor and pump means.

Preferably, the said capacitance measuring circuit comprises:

an oscillator producing a pulse output, pulse delay means receiving the oscillator pulse output and producing a fixed delay comparison pulse output, an RC circuit including the said capacitive liquid sensor as at least part of the capacitance thereof receiving the oscillator pulse output and producing a variable delay pulse output with a delay in dependence upon the sensor capacitance, comparison means receiving the said fixed delay comparison pulse output and said variable delay pulse output and producing either said first electric output or said second electric output as the result of its comparison thereof.

Also in accordance with the invention there is provided a capacitive liquid sensor for liquid-employing apparatus comprising a pair of spaced flat parallel conductive plates, and a liquid-carrying structure of non-conductive material between the plates establishing a tortuous elongated path between them for liquid which thereby constitutes part of the dielectric of the resultant capacitor.

Preferably, the said liquid-carrying structure comprises a pair of flat parallel tight spirals of tubing of non-conductive material having disposed between them a flat planar member to prevent the turns of one coil entering between the turns of the other, each of the coils being in physical contact with a respective one of the parallel conductive plates.

DESCRIPTION OF THE DRAWINGS

Particular preferred embodiments of the invention will now be described, by way of example, with reference to the accompanying diagrammatic drawings, wherein.

DESCRIPTION OF THE PREFERRED EMBODIMENTS

Figure 1:
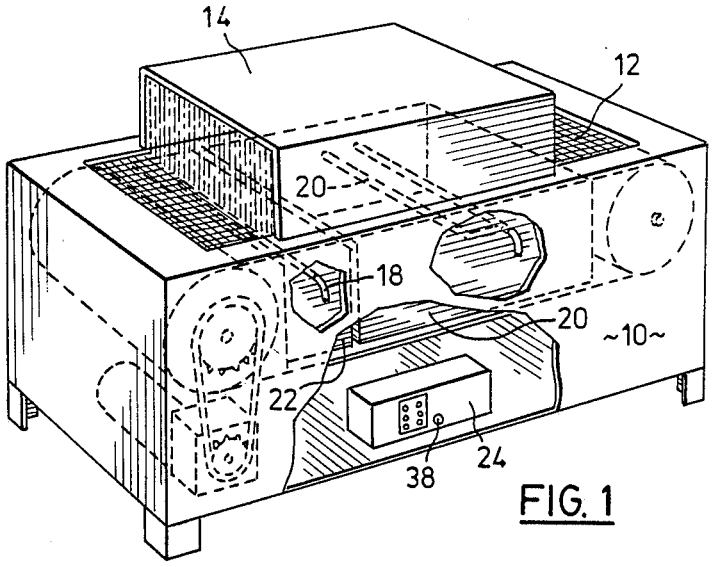
FIG. 1 is a general elevational view from one side of a typical glass washing apparatus employing the invention.

FIG. 1 illustrates a typical glass washing machine 10 of the type with which the invention can be employed, consisting of a frame mounting for longitudinal movement an endless perforated conveyor 12 on which the glasses are placed upside down. Upon activation of the conveyor, whether automatically or manually, the glasses are carried beneath a hood 14 in which they are spray-washed and then spray-rinsed by respective solutions delivered from nozzles 16 and 18 respectively. The wash and rinse liquids drain into respective tanks 20 and 22 from which they are pumped to the respective nozzles and to which they again drain. After each cycle of use the wash liquid is dumped to a drain, while the rinse liquid is transferred to the wash tank and used for washing. The pumps, pipes and valves employed for the rinsing, washing and recyling operations do not constitute part of the present invention and do not require specific illustration herein. The concentrated liquid chemical solutions to be added to the wash and rinse waters may be stored in respective storage containers (not shown) in the base of the machine or, more usually, are stored in larger containers external to the machine (also not shown) and are fed to a dispensing unit 24 of the invention via inlet pipes 26, 28 and 30, being fed by the unit 28 to the respective nozzles 16 and 18 via outlet pipes 32, 34 and 36. The dispensing unit illustrated is able to operate with three different liquids, but only two are employed in the washing machine illustrated.

Figure 2:
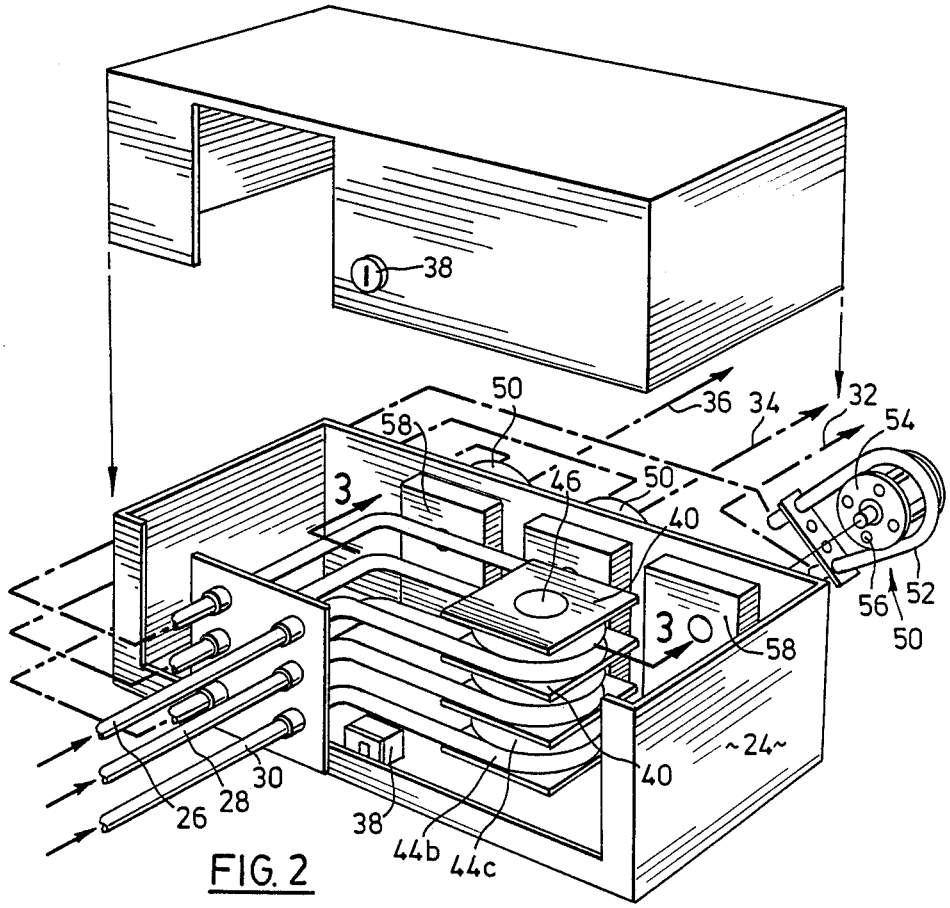
FIG. 2 is a general elevational view from one side of a liquid dispensing unit of the invention as employed in the apparatus of FIG. 1.
Figure 3:
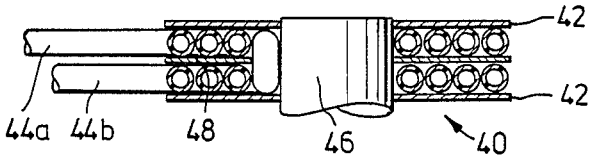
FIG. 3 is a perspective view to a larger scale of a capacitive detector as employed in the dispensing unit of FIG. 2.

The unit 24 comprises a metal container which is lockable by a lock 38, so that once appropriate adjustments have been set by the serviceman they cannot be changed by the machine operator. Liquid entering the unit 24 from one of the storage containers, first passes to a respective capacitive detector 40 of the three detectors that are provided in this particular embodiment. As seen more clearly in FIG. 3, each detector consists of two flat approximately square metal plates 42 between which are tightly sandwiched two parallel tightly wound spiral coils **44*a* and 44*b*, formed from plastic tubing and wound on a central core 46 so that their turns contact one another, the two coils having a flat planar member 48 constituted by a thin sheet of plastic interposed between them to facilitate their winding by preventing the turns of one coil from slipping randomly into the recessed between the turns of the other coil; this also ensures a more uniform value of capacitance for each detector. The liquid is drawn through the elongated tortuous path that is thereby established in the detector by a respective peristaltic-type pump 50, three of which are provided in this embodiment, although only one is seen in full in FIG. 2, one for each detector, each consisting of a single loop 52 of flexible plastic tubing, the inner surface of which is engaged by a rotor 54 having four axial equally circumferentially spaced bars 56 mounted thereon parallel to its axis of rotation. As each rotor is rotated by its respective motor 58 the bars press successively sufficiently tightly against the respective loop 52 to flatten it and force its liquid contents in the direction of rotation, the liquid exiting through outlet pipe 32**. The number of detectors, pumps and motors in a particular dispensing unit will of course depend upon the number of liquids to be handled in the particular apparatus. A glass washing apparatus usually will not require more than three (pre-rinse sanitizer, wash detergent and final rinse), but a drink dispenser will usually require many more than three to give an adequate selection of flavours.

In a particular embodiment each pair of detector coils **44*a* and 44*b* consists of about 120 cm (48 in.) of flexible transparent PVC pipe of 0.6 mm (0.25 in.) external diameter and 0.3 mm (0.125 in.) internal diameter wound tightly about a central core 46 of about 10 cm diameter, the plates 42** measuring about 10 cm by 10 cm (4 in. by 4 in.). The resultant capacitor when empty or full of a low dielectric liquid such as plain tap water has a capacitance between 30 and 50 picofarads; the specific example had a capacitance empty of 46 pF. The liquids normally used in glass washing machines will produce an increase in capacitance in such a detector of about 5–10 pF, when the coils are full.

Figure 4:
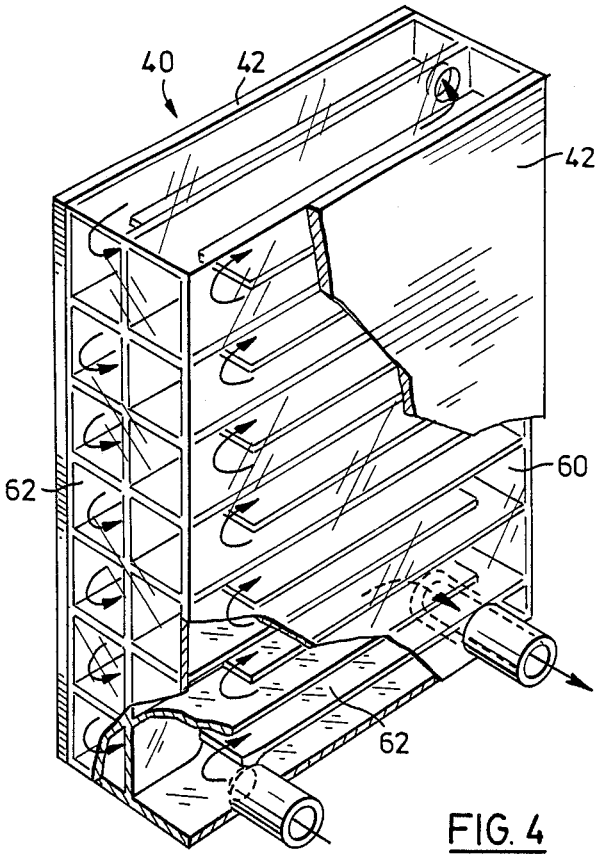
FIG. 4 is a similar view to FIG. 3 of an alternative structural form of the capacitive detector.

An alternative form of detector is illustrated by FIG. 4 and it will be seen that a plastic moulded body 60 is formed to provide, by means of internal baffles and partitions, in as compact a space as possible, the necessary elongated tortuous path 62 to ensure that a sufficient change of capacitance is obtained with the liquids employed, as compared with plain tap water. As explained above, it is desirable for the detector to detect the use of plain water as well as complete emptying thereof and, for the purpose of the subsequent description, reference to the detector being "empty" may also be taken as a reference to its being full of a low dielectric constant liquid such as tap water.

Figure 5:
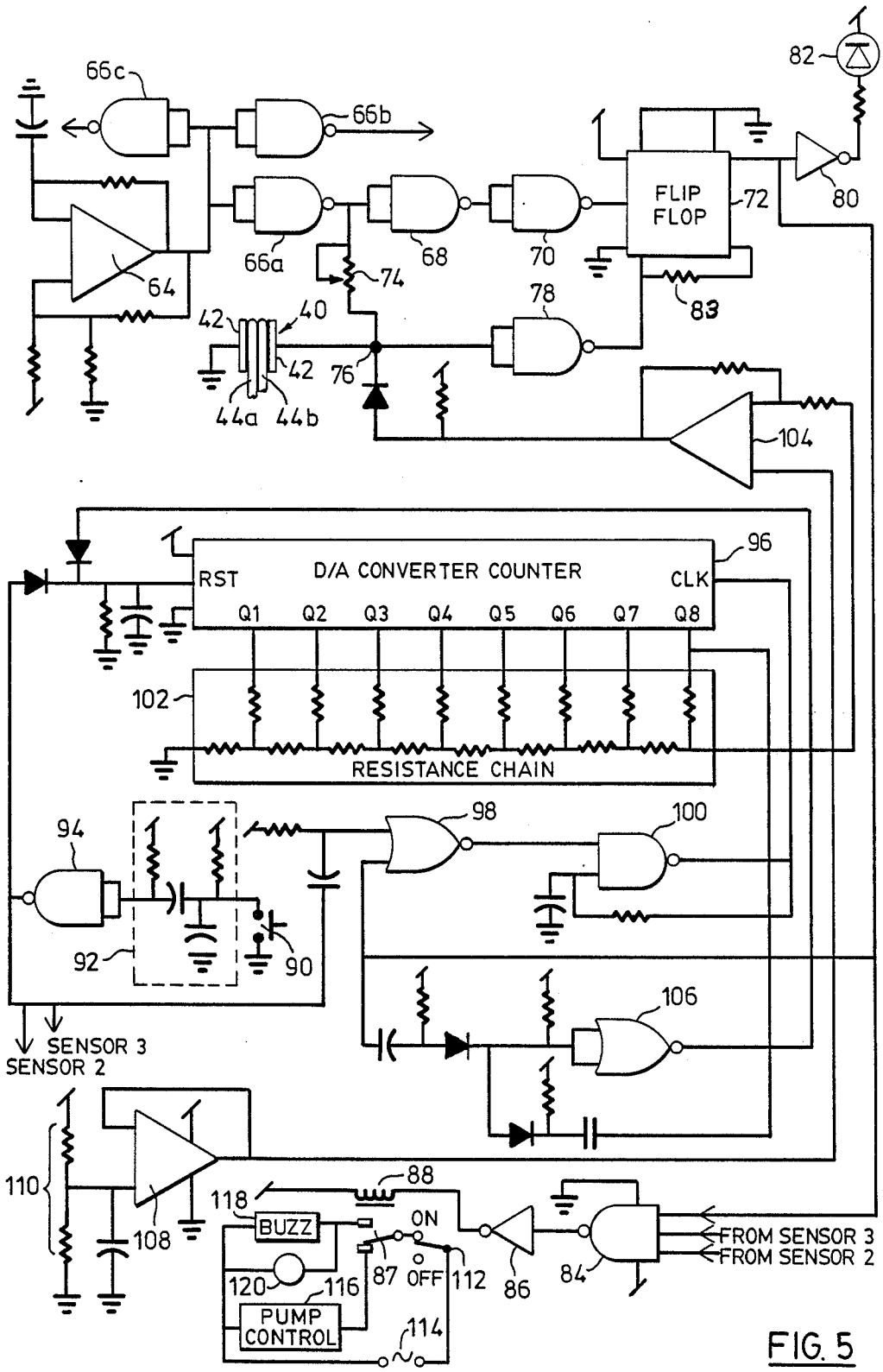
FIG. 5 is a diagram of the electrical circuit used in the dispensing unit of FIG. 2.

The operation of the electrical circuit portion of the machine will now be described with reference to FIGS. 5 and 6. The power supply (+5 volts regulated) required for its operation is not illustrated and will be apparent to those skilled in the art. An integrated circuit element 64 and the associated resistor and capacitor constitute a pulse oscillator producing an output voltage of about 1 KHz of approximately square wave pulse characteristic. A practical frequency range for the oscillator is 50 Hz to 10 KHz, the sensitivity of the circuit decreasing with increase in frequency. A single oscillator suffices to supply all of the detectors that may be provided in a single machine, and the circuit for each detector is fed from the oscillator via a respectivce NAND logic buffer **66*a*, 66*b* or 66*c*. Each buffer output is fed through a respective time delay means consisting of two series-connected NAND gates 68 and 70 to one input of a flip-flop circuit 72; the two gates together delay the pulse output of the buffer by a constant period of about 300–600 nanoseconds, as compared to the pulse length of about 500 microseconds. The buffer output is also fed to an RC circuit consisting of a variable sensitivity-adjusting resistor 74 and the capacitive sensor 40, and the resulting time delay applied to this train of pulses will depend upon the RC value, the value of C depending upon the dielectric constant of the liquid, if any, present in the coils 44*a* and 44*b*. The pulse train appearing at junction 76 is fed to a NAND gate 78 that reshapes the pulses and ensures that they are at proper voltage level to be fed to the flip-flop 72**.

If the capacitor detector is empty, or contains a low dielectric constant liquid, the pulses from shaper 78 arrive with their leading edges ahead of the corresponding pulses from delay means 68, 70, maintaining the flip-flop 72 with a low output and consequent low input to an inverter amplifier 80; the resulting high output from amplifier 80 extinguishes an LED indicator or annunciator 82 to show the operator that the corresponding liquid is exhausted, or is not suitable. Most of the detergent liquids used in a glass or dish washing machine are such as produce an increase in capacitance of the detector of about 5–10 picofarads; with such a liquid present, the RC value is increased by a corresponding amount and the delay produced at junction 76 is increased to the extent that the leading edges of the pulses therefrom now arrive at the flip-flop 72 just behind the leading edges of the corresponding pulses from gate 70, maintaining the flip-flop with a high output and inverter amplifier 80 with a low output, whereupon the LED display 82 is lit. A negative feedback resistor 83 is provided to stabilize the response of the flip-flop 72.

The outputs of all of the flip-flops 72 of the three detectors are fed to a common NAND gate 84 and if any of them becomes low the output of the gate goes from low to high; the consequent high input to an inverter amplifier 86 causes its output to open the contacts 87 of a relay 88 that controls supply of operating current to the pump motors 58. Thus, the contacts 87 are connected via an on/off switch 112 to the axial A.C. power supply 114. In one position of these contacts, power is supplied to a pump control 116 will operate the pumps, the type of control employed depending upon whether the pumps are of A.C. or D.C. type; the control may also operate the machine heaters. Upon "opening" of the contacts to stop the motors, another pair of the contacts is closed which cause an alarm buzzer 118 to sound and also cause a neon "out of chemical" indicator 120 to light. With this "empty" condition present the pump motors cannot operate, unless the relay is over-ridden by the operator by means of priming switches (not shown) that are operated so as to fill the system with liquid at start-up or re-start.

With the small changes in capacitance of the detector involved between its "full" and "empty" states some means must be provided for zeroing each detector circuit, and also for adjusting its sensitivity to suit the magnitude of the dielectric property of the solution detected. Thus, a highly ionized liquid, such as an iodine-based sanitizing liquid, will produce a much larger change in capacitance than the typical syrup used for soft drink dispensers. To calibrate the respective circuit the operator presses push button switch 90 resulting in the production of a pulse of about 50 milliseconds duration by the series-connected RC circuit 92, the output of which is fed to an NAND gate element 94 that is opeative to prevent multi-pulse production by contact bounce and to ensure the production of a pulse of the required level to actuate the remainder of the circuit. The pulse output from gate 94 is fed to the reset terminal RST of a counter 96 and resets it to zero if it is not at zero. The pulse also goes to one input of an NOR logic gate 98, causing it to produce an output pulse of about 200 milliseconds duration that, when fed to NAND logic element 100 connected to operate as an oscillator of about 1 KHz frequency, switches that oscillator on, causing it to feed its output pulses to the clock input terminal CLK of the counter 96. In this embodiment the counter 96 has eight couputs $Q_1$ through $Q_8$ to which a resistance chain 102 is connected, the output of the chain being an analog voltage whose value depends upon the count of the oscillator giving a digital/analog conversion. The analog voltage is fed to an input of an inverter 104, the output of which is connected to the junction 76 and biases the input to the gate 78. A change in the bias voltage at junction 76 is equivalent in effect to a change in the value of the sensitivity adjusting resistor to change the RC value and the consequent time delay.

Immediately when the counter 40 is set to zero the bias voltage at 76 is at its maximum and the circuit is at minimum sensitivity. When the counter oscillator 100 is switched on by operation of switch 90, the counter 96 counts progressively upward and an increasingly positive voltage is generated by the chain 102, resulting in the delivery of an increasingly negative bias voltage to the junction 76, progressively increasing the sensitivity. The output from the flip-flop 72 is also affected and is fed as another input to the NOR gate 98; when the output signal from the flip-flop suddenly changes from low to high and the indicator lights the pulses from the gate 98 cease and the oscillator 100 stops, stopping the counter at the output to which it has counted, the circuit thus being set automatically and held at the maximum sensitivity that is required for effective operation, it being understood that too great sensitivity could result in unstable operation. Similarly, when the output signal from the flip-flop 72 goes from high to low because the capacitor 42 is "empty", the element 98 is switched off and cannot operate in the absence of an enabling pulse, e.g. from the switch 90. This low signal is however also fed to a monostable oscillator consituted by NOR gate 106 which generates an output pulse that is fed to the reset input RST of the counter, returning it to zero and minimum sensitivity so that the circuit will no longer operate at all. An operator may attempt to re-start the apparatus with a sensor "empty" by pushing reset button 90, whereupon the counter 96 may count up to the most sensitive condition and stay there, giving the possibility that the apparatus will operate; this is prevented by the final counting stage also being connected so that it outputs to the reset pulse generator 106, which will reset the counter to zero and, as described above, cause the circuit to maintain minimum sensitivity.

It will be understood that practical operation of the circuit will usually require adjustment by the manufacturer between the manual adjustment provided by resistor 74 and the automatic sensitivity adjustment provided by the circuit. An empty sensor will stop the automatic adjustment at the same minimum sensitivity value as a tap water filled sensor, which will in turn stop at a lower sensitivity than with the usual chemical materials. For factory calibration of the circuit it is convenient to use a "standard chemical" solution, which is a solution prepated so as to have a dielectric constant slightly higher than tap water, so as to give a set point standard. Upon factory calibration of the circuit, and attempting to reset the circuit with the standard chemical it will not adjust automatically, then the sensitivity is decreased manually until operation is obtained, which will ensure automatic operation with any proper washing chemicals present.

Voltage reference in each sensor circuit is provided by a voltage follower operation amplifier 108 having an input fed from a voltage divider 110 supplied with the input voltage, the output of which amplifier is fed to the inverter 104 in the sensor circuit to increase the bias voltage and reduce the sensitivity as the input voltage increases. Temperature compensation is also be provided, if required, by a thermostat (not shown) in the ground leg of the resistors 110 of the voltage divider.

It will be seen that I have provided a new capacitive liquid sensor for liquid-employing machines that is simple in structure and an operating circuit therefor that is simple, reliable and flexible in operation, without the possibility of circumvention by an operator.

I claim:

1. A capacitive liquid sensor for liquid-employing apparatus comprising a pair of spaced flat parallel conductive plates, and a liquid-carrying structure constituted by a plurality of turns of non-conductive material disposed between the plates in physical contact therewith and establishing a tortuous elongated path between them for liquid which moves through the turns and thereby constitutes part of the dielectric of the resultant capacitor.

2. A sensor as claimed in claim 1, wherein the said liquid-carrying structure comprises a flat tight spiral of tubing of the non-conductive material.

3. A sensor as claimed in claim 1, wherein the said liquid-carrying structure comprises a pair of flat parallel tight spirals of said tubing having disposed between them a flat planar member to prevent the turns of one coil entering between the turns of the other, each of the coils being in physical contact with a respective one of the parallel conductive plates.

4. A capacitive liquid sensor for liquid-employing apparatus comprising a pair of spaced flat parallel conductive plates, and a liquid-carrying structure of non-conductive material disposed between the plates and establishing a tortuous elongated path between them for liquid which thereby constitutes part of the dielectric of the resultant capacitor, the said liquid-carrying structure comprising a moulded unitary body of plastic material having the tortuous elongated path established therein by internal baffles and partitions.

5. A liquid sensor system for liquid-employing apparatus comprising:

a capacitive liquid sensor adapted to have the liquid to be detected as part of the dielectric therein, a capacitance measuring circuit connected to the said capacitive detector and producing a first electric output when the detector is empty of liquid and a second output when it is full of liquid, said capacitance measuring circuit including sensitivity adjusting means operable upon start-up of the detector to adjust the sensitivity from a minimum toward a maximum and to stop and hold the sensitivity at a value at which the circuit detects the presence of the liquid in the capacitive detector, said sensitivity adjusting means comprising:

a counter, pulse means operable to start the counter in a counting sequence, means operable by the counter to produce a progressively changing analogue bias voltage as the counter counts, means applying the changing biasing voltage to the capacitance measuring circuit to change the sensitivity thereof, and means operable to stop and hold the counter and the corresponding bias voltage at the values corresponding to a change of the measuring circuit from the said first electric output to the second electric output, motor and pump means receiving liquid to be detected from a source thereof and pumping it through the capacitive detector, and motor control means operative upon receipt of said first electric output of the capacitance measuring circuit to stop operation of the motor and pump means.

6. A liquid sensor system for liquid-employing apparatus comprising:

a capacitive liquid sensor adapted to have the liquid to be detected as part of the dielectric therein, said capacitive liquid sensor comprising a pair of spaced parallel conductive plates, and a liquid-carrying structure of non-conductive material between the plates establishing a tortuous path between them for liquid which thereby constitutes part of the dielectric of the resultant capacitor, the said liquid-carrying structure comprising a moulded unitary body of plastic material having the tortuous elongated path established therein by internal baffles and partitions, a capacitance measuring circuit connected to the said capacitive detector and producing a first electric output when the detector is empty of liquid and a second output when it is full of liquid, motor and pump means receiving liquid to be detected from a source thereof and pumping it through the capacitive detector, and motor control means operative upon receipt of said first electric output of the capacitance measuring circuit to stop operation of the motor and pump means.

7. A liquid sensor system as claimed in claim 6, wherein said capacitance measuring circuit includes sensitivity adjusting means operable upon start-up of the detector to adjust the sensitivity from a minimum toward a maximum and to stop and hold the sensitivity at a value at which the circuit detects the presence of the liquid in the capacitive detector.

8. A liquid sensor system as claimed in claim 7, wherein the said sensitivity adjusting means comprises:

a counter, pulse means operable to start the counter in a counting sequence, means operable by the counter to produce a progressively changing analogue bias voltage as the counter counts, means applying the changing biasing voltage to the capacitance measuring circuit to change the sensitivity thereof, and means operable to stop and hold the counter and the corresponding bias voltage at the values corresponding to a change of the measuring circuit from the said first electric output to the second electric output.

9. A liquid sensor system as claimed in claim 6, wherein the said capacitance measuring circuit comprises:

an oscillator producing a pulse output, pulse delay means receiving the oscillator pulse output and producing a fixed delay comparison pulse output, an RC circuit including the said capacitive liquid sensor as at least part of the capacitance thereof receiving the oscillator pulse output and producing a variable delay pulse output with a delay in dependence upon the sensor capacitance, comparison means receiving the said fixed delay comparison pulse output and said variable delay pulse output and producing either said first electric output or said second electric output as the result of its comparison thereof.

10. A liquid sensor system as claimed in claim 9, wherein the said comparison means is a flip-flop circuit fed with said pulse outputs, the flip-flop circuit giving the said first electric output when the variable delay is more than the fixed delay, and giving the said second ouput when the variable delay is less than the fixed delay.

11. A liquid sensor system for liquid-employing apparatus comprising:

a capacitive liquid sensor adapted to have the liquid to be detected as part of the dielectric therein, said capacitance liquid sensor comprising a pair of flat spaced parallel conductive plates, and a plurality of turns of tubing of non-conductive material establishing a tortuous elongated path and disposed between the plates in physical contact therewith, through which turns moves the liquid to be detected, a capacitance measuring circuit connected to the said spaced conductive plates of the capacitive detector and producing a first electric output when the detector is empty of liquid and a second output when it is full of liquid, motor and pump means receiving liquid to be detected from a source thereof and pumping it through the said turns of the capacitive detector, and motor control means operative upon receipt of said first electric output of the capacitance measuring circuit to stop operation of the motor and pump means.

12. A liquid sensor system as claimed in claim 11, wherein said capacitance measuring circuit includes sensitivity adjusting means operable upon start-up of the detector to adjust the sensitivity from a minimum toward a maximum and to stop and hold the sensitivity at a value at which the circuit detects the presence of the liquid in the capacitive detector.

13. A liquid sensor system as claimed in claim 12, wherein the said sensitivity adjusting means comprises:

a counter, pulse means operable to start the counter in a counting sequence, means operable by the counter to produce a progressively changing analogue bias voltage as the counter counts, means applying the changing biasing voltage to the capacitance measuring circuit to change the sensitivity thereof, and means operable to stop and hold the counter and the corresponding bias voltage at the values corresponding to a change of the measuring circuit from the said first electric output to the second electric output.

14. A liquid sensor system as claimed in claim 11, wherein said liquid-carrying structure comprises a pair of flat parallel tight spirals of said tubing having disposed between them a flat planar member to prevent the turns of one coil entering between the turns of the other, each of the coils being in physical contact with a respective one of the parallel conductive plates.

15. A liquid sensor system as claimed in claim 11, wherein the said capacitance measuring circuit comprises:

an oscillator producing a pulse output, pulse delay means receiving the oscillator pulse output and producing a fixed delay comparison pulse output, an RC circuit including the said capacitive liquid sensor as at least part of the capacitance thereof receiving the oscillator pulse output and producing a variable delay pulse output with a delay in dependence upon the sensor capacitance, comparison means receiving the said fixed delay comparison pulse output and said variable delay pulse output and producing either said first electric output or said second electric output as the result of its comparison thereof.

16. A liquid sensor system as claimed in claim 15, wherein the said comparison means is a flip-flop circuit fed with said pulse outputs, the flip-flop circuit giving the said first electric output when the variable delay is more than the fixed delay, and giving the said second output when the variable delay is less than the fixed delay.

* * * * *